US011229113B1

(12) United States Patent
Starikovskiy et al.

(10) Patent No.: US 11,229,113 B1
(45) Date of Patent: Jan. 18, 2022

(54) DISCHARGE CELL SYSTEMS AND METHODS

(71) Applicant: METROLASER, INC., Laguna Hills, CA (US)

(72) Inventors: Andrey Y. Starikovskiy, Plainsboro, NJ (US); Jacob George, Downey, CA (US); Richard B. Miles, College Station, TX (US)

(73) Assignees: MetroLaser, Inc., Laguna Hills, CA (US); The Trustees of Princeton University, Princeton, NJ (US)

( * ) Notice: Subject to any disclaimer, the term of this patent is extended or adjusted under 35 U.S.C. 154(b) by 0 days.

(21) Appl. No.: 16/991,922

(22) Filed: Aug. 12, 2020

(51) Int. Cl.
*H05H 1/48* (2006.01)

(52) U.S. Cl.
CPC ..... *H05H 1/48* (2013.01)

(58) Field of Classification Search
CPC ..... H01J 37/32596; H05H 1/48–54
See application file for complete search history.

(56) References Cited

U.S. PATENT DOCUMENTS 3,363,140 A * 1/1968 Van Ornum ..... H05H 1/48 315/111.01
3,447,013 A * 5/1969 Van Ornum ..... H05H 1/48 313/12
3,519,927 A * 7/1970 Holt ..... G21K 1/043 324/409
3,534,214 A * 10/1970 Volker ..... H01J 61/28 313/231.61
3,551,737 A * 12/1970 Sheets ..... H05H 1/48 313/231.61
4,563,608 A * 1/1986 Lawson ..... H05H 7/00 313/231.01
4,774,914 A 10/1988 Ward
5,797,383 A 8/1998 Matsubara et al.
5,983,871 A 11/1999 Gordon et al.
6,651,637 B1 11/2003 Morrissette et al.
6,889,676 B2 5/2005 Morrissette et al.
7,013,881 B2 3/2006 Metzelard
7,093,422 B2 8/2006 Ponziani et al.
7,134,407 B1 11/2006 Nelson
7,267,115 B2 9/2007 Naruse et al.
7,267,116 B2 9/2007 Miwa et al.
7,418,956 B2 9/2008 Aida et al.
8,011,348 B2 9/2011 Starikovsky

* cited by examiner

*Primary Examiner* — Mariceli Santiago
(74) *Attorney, Agent, or Firm* — Haynes and Boone, LLP

(57) ABSTRACT

Described herein are systems and methods for ensuring plasma homogeneity in a discharge cell. The discharge cell may include a first hollow electrode and a second hollow electrode spaced away from the first electrode to define a discharge gap therebetween. A fluid inlet port may in fluid communication with an internal bore of the first electrode. A fluid outlet port may be in fluid communication with the discharge gap. A first pair of viewports may define a first optic pathway through the discharge gap. A second pair of viewports may define a second optic pathway through the discharge gap. A third pair of viewports may define a third optic pathway through the discharge gap, the third optic pathway defined through the hollow interior of the first and second electrodes.

20 Claims, 3 Drawing Sheets

DISCHARGE CELL SYSTEMS AND METHODS

STATEMENT REGARDING GOVERNMENT SUPPORT

This invention was made with government support under a Phase II SBIR contract entitled "Short Pulsed Laser Techniques for Measurement of Multiple Properties in High Enthalpy Facilities," Contract NNX16CA05C. The government has certain rights in the invention.

TECHNICAL FIELD

The present invention relates generally to discharge cell systems and methods and, more particularly, to discharge cell configurations designed to provide a homogeneous, strongly excited, low-temperature, non-equilibrium plasma with controllable and repeatable parameters.

BACKGROUND

Discharge cells provide reference sources of gas/plasma excitation and can be utilized as diagnostic and/or calibration devices for many applications. Some designs, however, may not permit homogeneous plasma production with controllable and repeatable parameters. Thus, a need in the art exists for discharge cell systems and methods that provide a homogeneous, strongly excited, low-temperature, non-equilibrium plasma with controllable and repeatable parameters.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
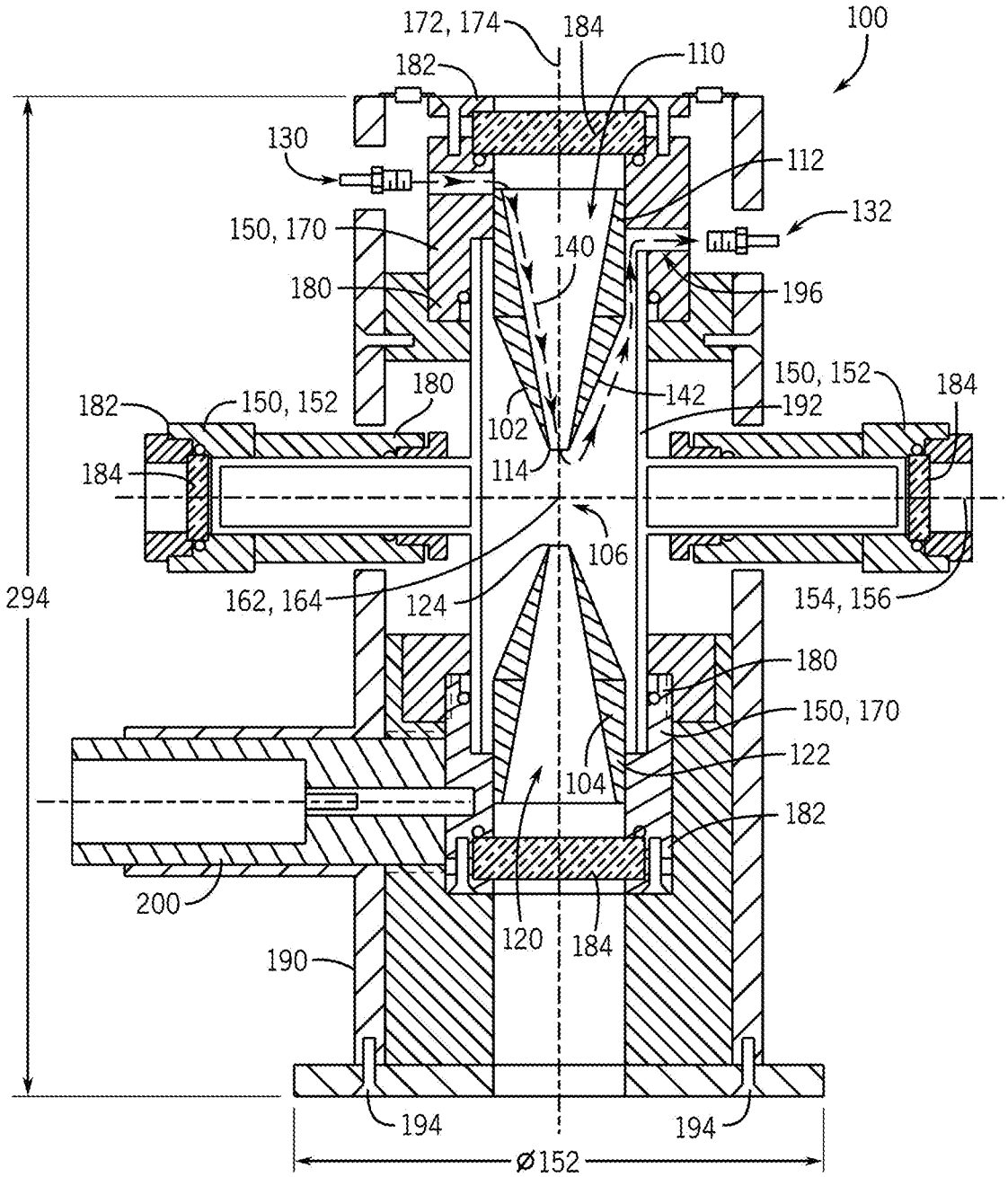
FIG. 1 illustrates a cross-sectional view of a discharge cell, according to an example of an embodiment of the present disclosure.

In various embodiments, systems and methods for ensuring plasma homogeneity in a discharge cell are provided. The discharge cell is designed to provide a homogeneous, strongly excited, low-temperature, non-equilibrium plasma with controllable and repeatable parameters. The discharge cell systems and methods described herein may provide a reference source of gas/plasma excitation that can be utilized as a calibration device for many existing and future diagnostic tools.

In various embodiments, a discharge cell includes a first hollow electrode and a second hollow electrode spaced away from the first electrode to define a discharge gap therebetween. A fluid inlet port may in fluid communication with an internal bore of the first electrode. A fluid outlet port may be in fluid communication with the discharge gap. A fluid pathway may be defined from the fluid inlet port, through the first internal bore and the first tip of the first electrode to the discharge gap, and to the fluid outlet port. A first pair of viewports may define a first optic pathway through the discharge gap. A second pair of viewports may define a second optic pathway through the discharge gap. A third pair of viewports may define a third optic pathway through the discharge gap, the third optic pathway defined through the hollow interior of the first and second electrodes.

In various embodiments, a method of ensuring plasma homogeneity in a discharge cell includes positioning a first hollow electrode within a housing, positioning a second hollow electrode within the housing, and defining a fluid pathway through the first electrode and the housing. The first electrode may have a first internal bore and a first tip. The second electrode may have a second internal bore and a second tip. The second electrode may be positioned to define a discharge gap between the first tip and the second tip. The housing may include a fluid inlet port and a fluid outlet port. The fluid pathway may extend from the fluid inlet port, through the first internal bore and the first tip, and to the fluid outlet port.

Formation of homogeneous plasma in molecular gases may be governed by various criteria. For example, formation of homogeneous plasma may be governed by the criteria established in U.S. Pat. No. 8,011,348, the disclosure of which is hereby incorporated by reference, for all purposes. Assuming the discharge has been generated by applying a high voltage electric pulse across a discharge gap, the criteria may be the following:

1) High-voltage pulse amplitude limited by the constraint, $U[kV]>3\cdot10^{-18}\times L\times n$, setting the value of reduced electric field E/n in the discharge gap after it is overlapped by the ionization wave at an E/n value greater than 300 Td;

2) High-voltage pulse amplitude limited by the constraint, $U[kV]<3\cdot10^{-17}\times L\times n$, setting the value of the reduced electric field E/n in the discharge gap after it is overlapped by the breakdown wave at the level of lower than 3000 Td;

3) High-voltage pulse leading edge rise time limited by the constraint, $t_f[ns]<3\cdot10^{-18}\times L^2\times n/U$;

4) High-voltage pulse leading edge rise time limited by the constraint, $t_f[ns]>RC$;

5) High-voltage pulse duration limited by the constraint, $t_{pul}[ns]<3\cdot10^{20}\times(L\times R)/n$;

6) High-voltage pulse duration limited by the constraint $t_{pul}[ns]>10^{17}/n$; and 7) Pulse interval limited by the constraint, $10^{26}\ U/(n\times L^2)>f_{pul}>V/L$ Where:

U—high-voltage pulse amplitude [kV], $t_{pul}$—high-voltage pulse duration [ns], $t_f$—high-voltage pulse front duration, [ns], R—impedance of the high-voltage PS with cable, C—capacitance of the discharge cell, n—molecular concentration in the unit of discharge section volume [$cm^{-3}$], L—discharge gap size [cm], $f_{pul}$—discharge frequency [Hz], and V—gas flow speed in the discharge section [cm/sec].

The above criteria or constraints may provide many benefits. For instance, the first criteria above may provide maximum discharge energy deposition into the electronic degrees of freedom and gas dissociation. The second criteria above may limit plasma electrons transfer into the run-away mode during the main stage of discharge and may minimize electron energy increase loss, electron beam formation, and X-ray emission. The third criteria above may allow increased voltage on the high-voltage electrode, thereby yielding an electric field intensity that is sufficient for electrons transfer into the run-away mode at the ionization wave front within a time span that is less than the time of overlapping of the discharge gap, thus ensuring the uniformity of filling the discharge gap with plasma. The fourth criteria above may allow the condition to match the high-voltage impulse generator with the discharge cell, which may ensure that the pulse energy transfer to plasma is highly effective. The fifth criteria above may limit the total energy input into gas-discharge plasma, thereby suppressing discharge instability development and providing a strong non-equilibrium pulse discharge plasma. The sixth criteria above may account for final time of electron multiplication in the discharge gap within the limits of fields limited by the first and second constraints. Such a condition may be required for gas ionization development in the gap after it is overlapped by the ionization wave, which then causes a reduction of the discharge gap resistance and a subsequent match of the discharge cell with the generator, thereby leading to an effective electric energy deposition into plasma. The seventh criteria above may provide a stable proceeding of chemical reactions in a continuous mode.

The above constraints may provide uniformity of gas excitation in a continuous mode ($f_{pul}$>V/L) and high effectiveness of strong non-equilibrium regime of excitation by nanosecond discharge with high duty-cycle ratio ($10^{26}$ U/(n× $L^2$)>$f_{pul}$). Such ensures that when the time between pulses exceeds the pulse duration and provides time that is sufficient for plasma recombination and recovery of electric strength of the discharge gap, thereby assuring operation in the selected ranges of reduce electric fields.

FIG. 1 illustrates a cross-sectional view of a discharge cell 100, according to an example of an embodiment of the present disclosure. The discharge cell 100 may be arranged or otherwise designed to satisfy the criteria noted above. As shown in FIG. 1, the discharge cell 100 includes a first electrode 102 and a second electrode 104 spaced away from the first electrode 102 to define an interelectrode or discharge gap 106 between the first and second electrodes 102, 104. For example, the first electrode 102 may be positioned in a spaced relationship above the second electrode 104, as shown in FIG. 1, or vice versa. Though FIG. 1 illustrates the first and second electrodes 102, 104 in vertical alignment, the first and second electrodes 102, 104 may be spaced horizontally or diagonally, among others, from each other depending on the application. The size of the discharge gap 106 may be controlled to ensure a desired plasma production for a wide range of gas concentrations and gas types. For instance, the first electrode 102 may be moved towards or away from the second electrode 104, or vice versa, to ensure the fulfillment of the seven criteria or constraints described above to ensure the creation/production of a homogeneous, strongly excited, low-temperature, non-equilibrium plasma in the discharge gap 106.

The first and second electrodes 102, 104 may be any electrical conductor used to create a circuit. Depending on the application, the first electrode 102 may be referred to as a low-voltage electrode, a negative electrode, a cathode, or an anode. The second electrode 104 may be referred to as a high-voltage electrode, a positive electrode, a cathode, or an anode.

The first and second electrodes 102, 104 may include many configurations ensuring plasma homogeneity in the discharge gap 106. For instance, the first electrode 102 may have a first internal bore 110 such that the first electrode 102 is hollow. In such embodiments, the first electrode 102 may be referred to as a first hollow electrode. In some embodiments, the first electrode 102 may be shaped as a hollow cone with a first base 112 and a first tip 114. Such a hollow cone shape may 1) increase the effective area of emission from the electrode, 2) limit development of cathode or anode spots, and/or 3) increase the uniformity of the plasma in the discharge gap 106. The first tip 114 of the first electrode 102 may be shaped with a sharp edge. The sharp edge may 1) increase the magnitude of the electric field at the edge of the first electrode 102, 2) facilitate the start of the discharge, and/or 3) increase the uniformity of the plasma in the discharge gap 106.

The second electrode 104 may be configured similarly to the first electrode 102. For example, the second electrode 104 may have a second internal bore 120 such that the second electrode 104 is hollow and is referred to as a second hollow electrode. The second electrode 104 may be shaped as a hollow cone with a second base 122 and a second tip 124. The hollow cone shape of the second electrode 104 may provide the same benefits outlined above, whether alone or in combination with the hollow cone shape of the first electrode 102. The second tip 124 of the second electrode 104 may be shaped with a sharp edge, with the sharp edge of the second electrode 104 providing the same benefits outlined above, whether alone or in combination with the sharp tip edge of the first electrode 102.

In various embodiments, the discharge cell 100 may be configured to facilitate replacement of fluid in the discharge gap 106. For example, the configuration of the discharge cell 100 may ensure a complete change of fluid in the discharge gap 106 due to organization of fluid flow through at least one of the first and second electrodes 102, 104. Depending on the application, replacement of fluid within the discharge gap 106 may be provided from a low voltage electrode, such as the first electrode 102, to ensure the absence of a parasitic discharge in the fluid supply and/or return lines. The fluid may be any one or combination of liquids, gases, and plasma. For example, the fluid may be an inert gas, though any other fluid is contemplated permitting plasma production/discharge in the discharge gap 106.

As shown in FIG. 1, the discharge cell 100 may include a fluid inlet port 130 and a fluid outlet port 132. In such embodiments, fluid may flow from the fluid inlet port 130 and to the fluid outlet port 132 to replace the fluid within the discharge gap 106. The fluid inlet port 130 may be in fluid communication with the first internal bore 110 of the first electrode 102. In such embodiments, a fluid pathway 140 may be defined from the fluid inlet port 130 through the first internal bore 110 and the first tip 114 of the first electrode 102. The fluid outlet port 132 may be configured and/or positioned such that fluid exiting the first tip 114 of the first electrode 102 exits through the fluid outlet port 132. In one or more embodiments, the fluid outlet port 132 may be adjacent to an external side surface 142 of the first electrode 102. In this manner, fluid contaminated with plasma products may be pumped out through the fluid outlet port 132 along or near the external side surface 142 of an electrode. The fluid inlet port 130 and the fluid outlet port 132 may be defined by one or more elements connected to the discharge cell 100. For instance, each of the fluid inlet port 130 and the fluid outlet port 132 may be defined by a valve, fitting, pipe, conduit, hose, or the like, or any combination thereof, connected to the discharge cell 100. In some embodiments, the fluid inlet port 130 and the fluid outlet port 132 may be defined by one or more structures of the discharge cell 100 itself. For example, the fluid inlet port 130 and/or the fluid outlet port 132 may be defined at least partially by cutouts, apertures, or bores defined in or through portions of the discharge cell 100.

In various embodiments, the discharge cell 100 may include one or more viewports 150 permitting the use of one or more optical and/or laser diagnostic methods of the plasma generated in the discharge gap 106. Depending on the application, the viewports 150 may be arranged in opposing pairs to define one or more diagnostic pathways through the discharge gap 106. For instance, the discharge cell 100 may include a first pair of viewports 152 defining a first optic pathway 154 through the discharge gap 106. The first pair of viewports 152 may be positioned on a first set of opposing sides of the discharge cell 100, such as on opposing left and right sides of the discharge cell 100, to define the first optic pathway 154 along a first axis 156. The discharge cell 100 may include a second pair of viewports 160 defining a second optic pathway 162 through the discharge gap 106. The second pair of viewports 160 may be positioned on a second set of opposing sides of the discharge cell 100, such as on opposing front and rear sides of the discharge cell 100, to define the second optic pathway 162 along a second axis 164. The discharge cell 100 may include a third pair of viewports 170 defining a third optic pathway 172 through the discharge gap 106. The third pair of viewports 170 may be positioned on a third set of opposing sides of the discharge cell 100, such as on opposing top and bottom sides of the discharge cell 100, to define the third optic pathway 172 along a third axis 174. In some embodiments, the first, second, and third optic pathways 154, 162, 172 may define mutually perpendicular axes. For example, the first, second, and third axes 156, 164, 174 may be mutually perpendicular to one another. In this manner, the first, second, and third optic pathways 154, 162, 172 may define a 6-way cross. The optic pathways may permit a laser line to be transmitted through the discharge gap 106. The optic pathways may also permit other optic diagnostic methods of the discharge gap 106.

The one or more viewports 150 may include many configurations. For instance, each viewport 150 may include a first end 180, an opposing second end 182, and an optical window 184. The first end 180 may be positioned adjacent to the discharge gap 106, with the second end 182 positioned away from the discharge gap 106. The optical window 184 may be positioned adjacent to the second end 182 to space the optical window 184 away from the discharge gap 106. Such a configuration may limit contamination of the optical window 184 with discharge products or material. Spacing the optical window 184 away from the discharge gap 106 may also create necessary space for beam focusing, such as required for laser diagnostic methods of the discharge gap 106.

In various embodiments, the discharge cell 100 may include one or more housings securing the various components together and/or shielding the discharge cell 100 from contaminants. For instance, the discharge cell 100 may include an outer housing 190 and an inner housing 192 mounted within the outer housing 190. The outer housing 190 may be conductive to limit the electromagnetic noise created by the discharge and to facilitate the plasma diagnostic methods of the discharge. For instance, the outer housing 190 may be constructed of aluminum or other conductive metal. As shown in FIG. 1, the fluid inlet port 130 and the fluid outlet port 132 may be defined through the outer housing 190. In some embodiments, the fluid inlet port 130 and the fluid outlet port 132 may be defined through the outer housing 190 adjacent to the first electrode 102 to facilitate efficient replacement of fluid in the discharge gap 106 via the first electrode 102. For instance, the fluid pathway 140 may be defined through the outer housing 190 via the fluid inlet port 130, through the first internal bore 110 and first tip 114 of the first electrode 102, along or adjacent to the external side surface 142 of the first electrode 102, and through the outer housing 190 via the fluid outlet port 132. The outer housing 190 may be mountable to an external base or structure, such as to a testing or holding apparatus. For instance, the outer housing 190 may be secured to an external structure or apparatus via one or more fasteners 194 or other attachment means.

The inner housing 192 may be a nonconductive casing mounted within the outer housing 190. For example, the inner housing 192 may be a quartz tube or a glass cell, though other configurations are contemplated. At least a portion of each of the first and second electrodes 102, 104 may be mounted within the inner housing 192 to define the discharge gap 106 between the first electrode 102, the second electrode 104, and the inner housing 192. At least a portion of the inner housing 192 may define the fluid pathway 140 through which fluid is replaced in the discharge gap 106. For example, as shown in FIG. 1, the inner housing 192 may include a cutout 196 to define a portion of the fluid pathway 140 from the discharge gap 106 to the fluid outlet port 132. Depending on the application, the cutout 196 may be defined adjacent to the first base 112 of the first electrode 102 to facilitate fluid replacement along or near the external side surface 142 of the first electrode 102.

As shown in FIG. 1, at least one of the viewports 150, such as the first pair of viewports 152 and the second pair of viewports 160, may extend through the outer housing 190 for positioning adjacent to the inner housing 192. For instance, the first pair of viewports 152 and the second pair of viewports 160 may penetrate the outer housing 190 to position the first end 180 of the viewports adjacent to the inner housing 192, such as in close proximity or in abutting engagement.

The discharge cell 100 may include various other components for convenience. For instance, the discharge cell 100 may include a direct current sensor measuring the electrical current passing through the low-voltage electrode. As shown in FIG. 1, the discharge cell 100 may include a power supply connection 200. The power supply connection 200 may be adjacent to the second base 122 of the second electrode 104 to supply electrical power to the second electrode 104.

Figure 2:
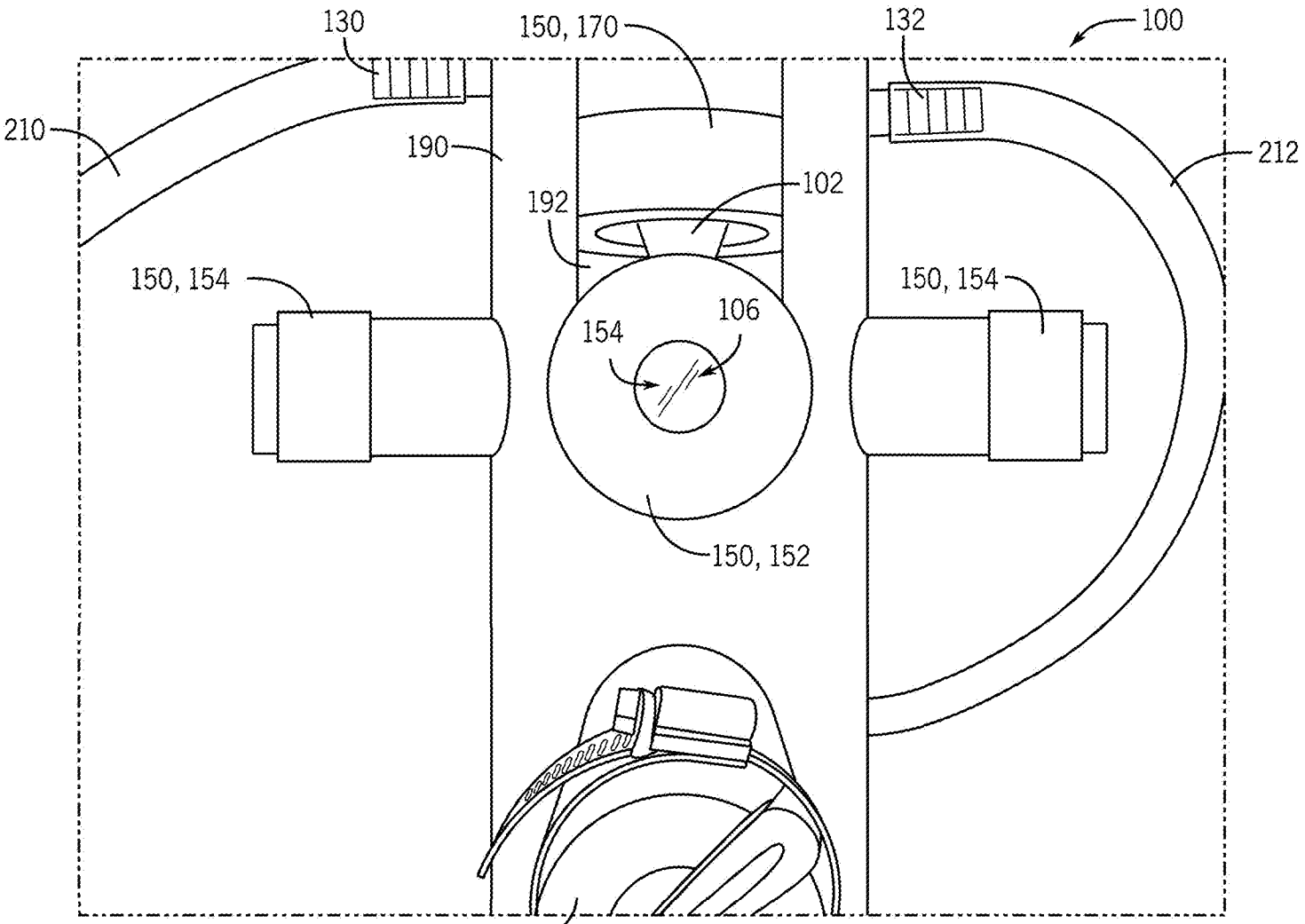
FIG. 2 illustrates a perspective view of the discharge cell of FIG. 1, according to an example of an embodiment of the present disclosure.

FIG. 2 illustrates a perspective view of the discharge cell 100, according to an example of an embodiment of the present disclosure. FIG. 2 illustrates the first electrode 102, one viewport of the first pair of viewports 152 (e.g., a left viewport), the second pair of viewports 160, and one viewport of the third pair of viewports 170 (e.g., a top viewport). FIG. 2 also illustrates the outer housing 190, a top portion of the inner housing 192, the fluid inlet port 130, the fluid outlet port 132, and the power connection. FIG. 2 further illustrates a fluid supply line 210 connected to the fluid inlet port 130, and a fluid return line 212 connected to the fluid outlet port 132. The first optic pathway 154 through the first pair of viewports 152 is also illustrated in FIG. 2.

Figure 3:
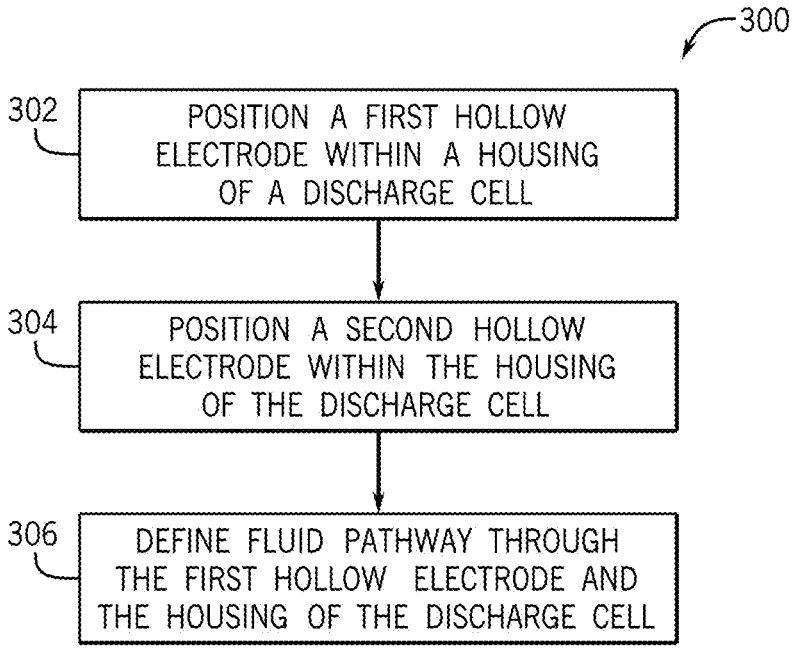
FIG. 3 is a flowchart detailing a method of ensuring plasma homogeneity in a discharge cell, according to an example of an embodiment of the present disclosure.

FIG. 3 is a flowchart detailing a method 300 of ensuring plasma homogeneity in a discharge cell, according to an example of an embodiment of the present disclosure. In block 302, the method 300 includes positioning a first hollow electrode within a housing. In block 304, the method 300 includes positioning a second hollow electrode within the housing. The first hollow electrode may be similar to the first electrode 102 of FIG. 1, described above. For instance, the first hollow electrode may include a first internal bore and a first tip. The second hollow electrode may be similar to the second electrode 104 of FIG. 1, described above. For instance, the second hollow electrode may include a second internal bore and a second tip. The second hollow electrode may be positioned within the housing to define a discharge gap between the first tip and the second tip of the first and second hollow electrodes, respectively. The discharge gap may be similar to the discharge gap 106 of FIG. 1, described above.

Block 302 may include mounting at least a portion of the first hollow electrode within a nonconductive housing portion of the discharge cell, such as within the inner housing 192 of FIG. 1, described above. Block 304 may include mounting at least a portion of second hollow electrode within the nonconductive housing portion of the discharge cell, such as within the inner housing 192 of FIG. 1, described above. In some embodiments, the method 300 may include mounting the nonconductive housing portion within a conductive housing portion of the discharge cell, such as within the outer housing 190 of FIG. 1, described above. The relative positions of the first and second hollow electrodes may be modified to control the size of the discharge gap, such as for different gas concentrations and/or gas types. For instance, the position of the first hollow electrode may be modified relative to the second hollow electrode to change one or more dimensions of the discharge gap to ensure homogeneity of plasma production within the discharge gap.

In block 306, the method 300 includes defining a fluid pathway through the first hollow electrode and the housing. The fluid pathway may extend from a fluid inlet of the housing (e.g., the fluid inlet port 130 of FIG. 1, described above), through the first hollow electrode, and to a fluid outlet of the housing (e.g., the fluid outlet port 132 of FIG. 1, described above). In such embodiments, the method 300 may include moving fluid through the fluid pathway to replace the fluid in the discharge gap. In this manner, fluid within the discharge gap and contaminated with plasma products may be replaced with uncontaminated fluid moving through the fluid pathway. In some embodiments, fluid may be moved through the fluid pathway in a continuous manner during operation of the discharge cell.

In some embodiments, the method 300 may include monitoring the plasma production/discharge within the discharge gap. For instance, one or more pairs of viewports (e.g., the first, second, and third pairs of viewports of FIG. 1, described above) may be mounted to the housing adjacent to the discharge gap to define one or more optic pathways through the discharge gap (e.g., the first, second, and third optic pathways 154, 162, 172 of FIG. 1, described above). The optic pathways may permit one or more plasma diagnostic methods, such as one or more optical and/or laser diagnostic methods of the plasma generated in the discharge gap.

Embodiments described above illustrate, but do not limit, the invention. It should also be understood that numerous modifications and variations are possible in accordance with the principles of the present invention. Accordingly, the scope of the invention is defined only by the following claims.

What is claimed:

1. A discharge cell comprising:

a first hollow electrode having a first internal bore and a first tip;

a second hollow electrode having a second internal bore and a second tip, the second electrode spaced away from the first electrode to define a discharge gap between the first and second electrodes;

a fluid inlet port in fluid communication with the first internal bore of the first electrode; and a fluid outlet port in fluid communication with the discharge gap;

wherein a fluid pathway is defined from the fluid inlet port, through the first internal bore and the first tip of the first electrode to the discharge gap, and to the fluid outlet port, wherein each of the first and second electrodes is shaped as a hollow cone, and wherein each of the first and second tips is defined as an edge.

2. The discharge cell of claim 1, wherein the fluid outlet port is adjacent to an external side surface of the first electrode.

3. The discharge cell of claim 1, further comprising:

a first pair of viewports defining a first optic pathway through the discharge gap;

a second pair of viewports defining a second optic pathway through the discharge gap; and a third pair of viewports defining a third optic pathway through the discharge gap, the third optic pathway defined through the first internal bore and the second internal bore;

wherein the first, second, and third optic pathways permit one or more optical or laser diagnostic methods of the discharge gap.

4. The discharge cell of claim 3, further comprising:

a conductive outer housing; and a nonconductive inner housing mounted within the outer housing, at least a portion of each of the first and second electrodes mounted within the inner housing to define the discharge gap between the first electrode, the second electrode, and the inner housing.

5. The discharge cell of claim 3, wherein the first, second, and third optic pathways define mutually perpendicular axes.

6. The discharge cell of claim 5, wherein each viewport of the first, second, and third pairs of viewports comprises:

a first end adjacent to the discharge gap;

a second end spaced away from the first end; and an optical window positioned adjacent to the second end.

7. The discharge cell of claim 1, wherein the first electrode is a low-voltage electrode, and wherein the second electrode is a high-voltage electrode.

8. The discharge cell of claim 7, further comprising a direct current sensor measuring the electrical current passing through the low-voltage electrode.

9. A system comprising:

the discharge cell of claim 1;

a conductive outer housing in which the discharge cell is mounted; and a nonconductive inner housing mounted within the outer housing.

10. The system of claim 9, wherein at least a portion of each of the first and second electrodes is mounted within the nonconductive inner housing to define the discharge gap between the first electrode, the second electrode, and the nonconductive inner housing.

11. The system of claim 10, wherein the conductive outer housing comprises the fluid inlet port and the fluid outlet port.

12. The system of claim 10, wherein the inner housing comprises a cutout to define a portion of the fluid pathway.

13. A method of ensuring plasma homogeneity in a discharge cell, the method comprising:

positioning a first hollow electrode within a housing, the first electrode having a first internal bore and a first tip, the first electrode shaped as a hollow cone, the first tip defined as a first edge;

positioning a second hollow electrode within the housing, the second electrode having a second internal bore and a second tip, the second electrode positioned to define a discharge gap between the first tip and the second tip, the second electrode shaped as a hollow cone, the second tip defined as a second edge; and defining a fluid pathway through the first electrode and the housing, wherein the fluid pathway extends from a fluid inlet port of the housing, through the first internal bore and the first tip, and to a fluid outlet port of the housing.

14. The method of claim 13, wherein:

positioning the first and second electrodes within the housing comprises mounting at least a portion of each of the first electrode and the second electrode within a nonconductive housing portion; and the method further comprises mounting the nonconductive housing portion within a conductive housing portion.

15. The method of claim 13, further comprising modifying the position of the first electrode relative to the second electrode to control the size of the discharge gap for different gas concentrations and/or gas types.

16. The method of claim 13, further comprising moving fluid through the fluid pathway to replace the fluid in the discharge gap.

17. The method of claim 13, further comprising mounting one or more pairs of viewports to the housing adjacent to the discharge gap to define one or more optic pathways through the discharge gap.

18. The method of claim 17, wherein the mounting one or more pairs of viewports to the housing comprises:

mounting a first pair of viewports to define a first optic pathway through the discharge gap;

mounting a second pair of viewports to define a second optic pathway through the discharge gap; and mounting a third pair of viewports to define a third optic pathway through the discharge gap, the third optic pathway defined through the first internal bore and the second internal bore.

19. The method of claim 13, wherein the fluid outlet port is defined adjacent to an external side surface of the first electrode.

20. The method of claim 13, wherein the fluid pathway is defined through a cutout of an inner housing of the discharge cell.

* * * * *